US006651896B1

(12) United States Patent
Foan

(10) Patent No.: US 6,651,896 B1
(45) Date of Patent: Nov. 25, 2003

(54) RAIL MOUNTING SYSTEM

(75) Inventor: Andrew Raymond Foan, Nottingham (GB)

(73) Assignee: Balfour Beatty plc, London (GB)

( * ) Notice: Subject to any disclaimer, the term of this patent is extended or adjusted under 35 U.S.C. 154(b) by 0 days.

(21) Appl. No.: 10/148,147

(22) PCT Filed: Nov. 23, 2000

(86) PCT No.: PCT/GB00/04468

§ 371 (c)(1),
(2), (4) Date: Oct. 15, 2002

(87) PCT Pub. No.: WO01/38641

PCT Pub. Date: May 31, 2001

(30) Foreign Application Priority Data

Nov. 23, 1999 (GB) ..... 9927691

(51) Int. Cl.[7] ..... E01B 9/00

(52) U.S. Cl. ..... 238/282; 238/264; 238/265; 238/287; 238/338; 238/349

(58) Field of Search ..... 238/264, 265, 238/269, 282, 297, 301, 306, 307, 310, 315, 321, 322, 323, 324, 331, 338, 339, 341, 343, 348, 349, 351, 352, 353, 354, 287

(56) References Cited

U.S. PATENT DOCUMENTS

| | | | | | |
|---|---|---|---|---|---|
| 1,026,657 | A | * | 5/1912 | Chila | 238/65 |
| 1,189,489 | A | * | 7/1916 | Russell | 238/304 |
| 1,252,971 | A | * | 1/1918 | Vasdahl | 238/341 |
| 1,315,132 | A | * | 9/1919 | Knox | 238/338 |
| 1,428,378 | A | * | 9/1922 | Hess et al. | 238/304 |
| 1,470,090 | A | * | 10/1923 | Manning | 238/341 |
| 1,754,917 | A | * | 4/1930 | Vare | 238/70 |
| 1,845,990 | A | * | 2/1932 | Schwinn | 238/304 |
| 3,362,639 | A | * | 1/1968 | Van Sant | 238/349 |
| 3,429,505 | A | * | 2/1969 | Newton | 238/349 |
| 3,758,032 | A | * | 9/1973 | Varga et al. | 238/338 |

FOREIGN PATENT DOCUMENTS

| | | |
|---|---|---|
| FR | 2541699 | 2/1984 |
| WO | WO 96/23107 | 8/1996 |

* cited by examiner

*Primary Examiner*—Mark T. Le
(74) *Attorney, Agent, or Firm*—Blakely, Sokoloff, Taylor & Zafman

(57) ABSTRACT

A rail mounting system for mounting a rail (31), to a rail bearing (20), the mounting system comprising a tapered baseplate (26, 27) for supporting the base flange of a rail (30) on the rail bearing at an inclination thereto, and clamp devices (34, 35, 36, 37) for urging the base flange of the rail onto the baseplate and rail bearing. The baseplate (26) is secured to the rail bearing (20) solely by virtue of the compressive force exerted by the clamp devices through the base flange of the rail.

10 Claims, 3 Drawing Sheets

PRIOR ART
FIG 1
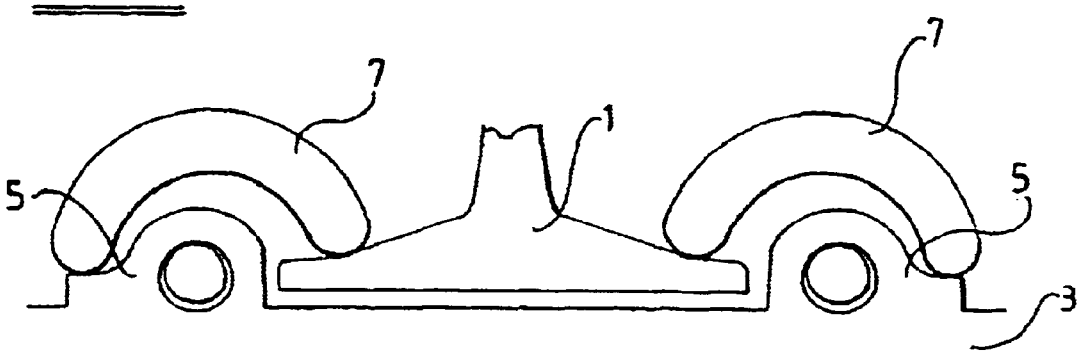
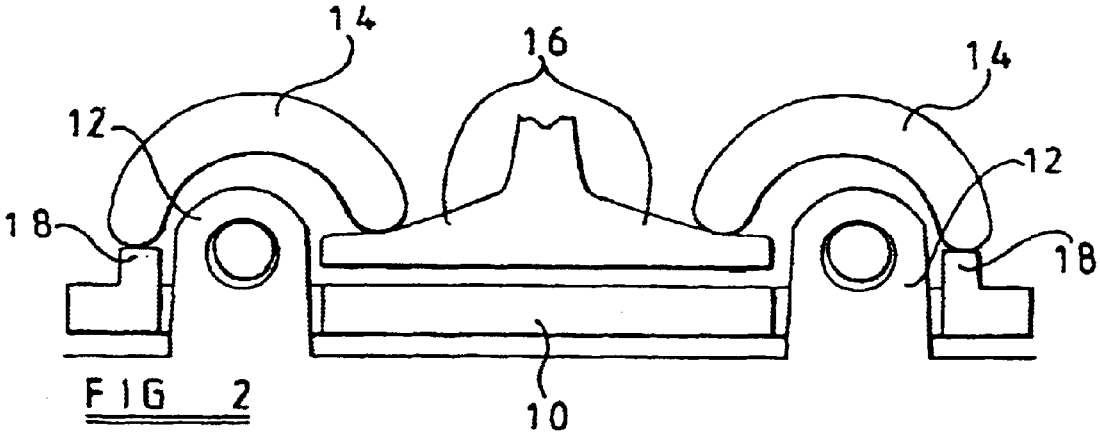
FIG 2
PRIOR ART
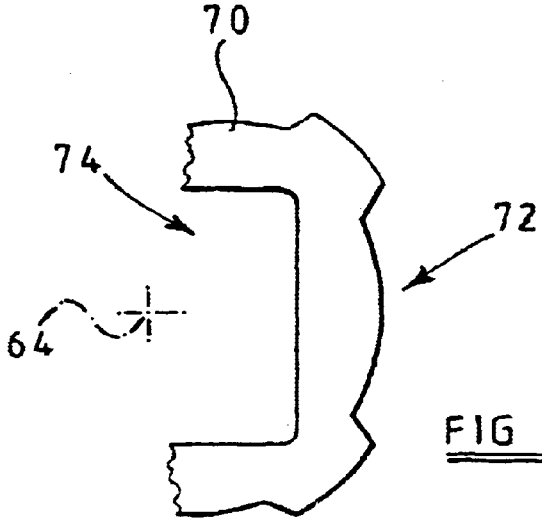
FIG 7

RAIL MOUNTING SYSTEM

This invention relates to a rail mounting system for mounting a rail on a rail bearing in the permanent way of a railway or like system. In particular, it relates to such systems for use at switches and crossings.

FIG. 1 shows a conventional rail mounting system used at positions away from switches and crossings. The rail 1 is mounted on the sleeper 3 by means of upstanding shoulders 5 cast or glued into the sleeper on either side of the rail, and clips 7 which are anchored to the shoulders, the toes of the clips bearing down onto the flanges on either side of the rail to hold it onto the sleeper. To improve rail-wheel performance, the bearing surface of the sleeper is inclined (not shown), typically by 1:20 or 1:40.

At switches and crossings, due to the diverging or converging tracks, the positions of the rails relative to each other changes from one rail bearer to the next. Since it is not always practical to provide sleepers with appropriately inclined rail bearing surfaces for each position at switches and crossings, flat bearers are often used in such positions. In order to provide an inclination to the rails, it is known to fasten baseplates cast with the required inclination onto the bearers. FIG. 2 shows a known so-called "pop-up shoulder" rail mounting system for use at switches and crossings in which the baseplate 10 is formed with a hole or slot on either side of the inclined surface to allow a centre stem shoulder 12, which is cast or glued into the bearer, to pass through the baseplate. The centre stem shoulder provides an orifice for anchoring the middle arm of an elastic rail e-clip 14, the toe of the clip bearing directly down onto the rail flange 16, and the heel bearing down onto a raised reaction pad 18 formed on the baseplate.

Although such rail mounting systems function very well, the manufacturing tolerances required for the shoulders and baseplates must be relatively tight, since any variation in the relative heights of shoulder and baseplate will affect both the toe and heel of the clip, so resulting in a twofold effect on the force exerted by the clip. Furthermore, the baseplates are required to be considerably longer than the width of the rail they are supporting in order to accommodate the hole or slot either side of the rail for receiving the centre stem shoulder and to provide sufficient area for the raised reaction pad. Besides the expense involved with manufacturing long baseplates, at positions where rails converge, such longer baseplates must be replaced by special baseplates which support both converging rails from a position when the rails are further apart than would be the case if shorter baseplates could be used. Such special baseplates are more expensive to produce, since they must be designed for each particular installation position. It is therefore an object to provide a rail mounting system which is cheaper to manufacture and install at switches and crossings than current rail mounting systems.

According to the invention, there is provided a rail mounting system for mounting a rail to a rail bearing, the mounting system comprising a tapered baseplate for supporting the base flange of a rail on the rail bearing at an inclination thereto, and clamp means for urging the-base flange of the rail onto the baseplate and rail bearing, characterised in that the baseplate is secured to the rail bearing solely by virtue of the compressive force exerted by the clamp means through the base flange of the rail.

By securing the baseplate to the rail bearing solely by virtue of the compressive force exerted by the clamp means through the base flange of the rail, the length of the baseplate need be no longer than the width of the rail it supports. This means that rails can be mounted closer together using single-rail baseplates ('standard baseplates') than was possible using the "pop-up shoulder" system. This means that fewer special baseplates are required per switch/crossing. Furthermore, because the baseplate is only subject to compressive forces, it may be made of relatively low strength materials.

Suitably, each clamp comprises a clip mounted at a suitable height relative to the rail bearing to bear down onto the base flange of the rail. The clip may be mounted on a shoulder upstanding from the rail bearing, and a baseplate locator may be positioned between the baseplate and shoulder to provide a positive location of the baseplate between shoulders.

By use of a baseplate locator as described, the baseplate may be shorter than the width of the rail and yet remain positively located between shoulders such that it cannot move out of position due to any relative movement between the rail and bearer.

Suitably, the baseplate locator comprises a ring mounted around the shoulder and having a peripheral edge that abuts the end of the baseplate. Preferably, the peripheral edge of the ring has a cam profile to allow adjustment of the location of the baseplate by rotation of the ring.

By providing a degree of adjustment of the position of the baseplate in this manner, the same special baseplate design for supporting two adjacent converging rails can be used at several different positions along the track, even though the distance between the rails will be different at each position. In this way the number of special baseplate designs required for each switch and crossing may be further reduced.

FIGS. 1 and 2 show conventional rail mounting systems.

FIG. 7 shows an alternative spacing device for use in the rail mount of FIGS. 5 and 6.

Figure 3:
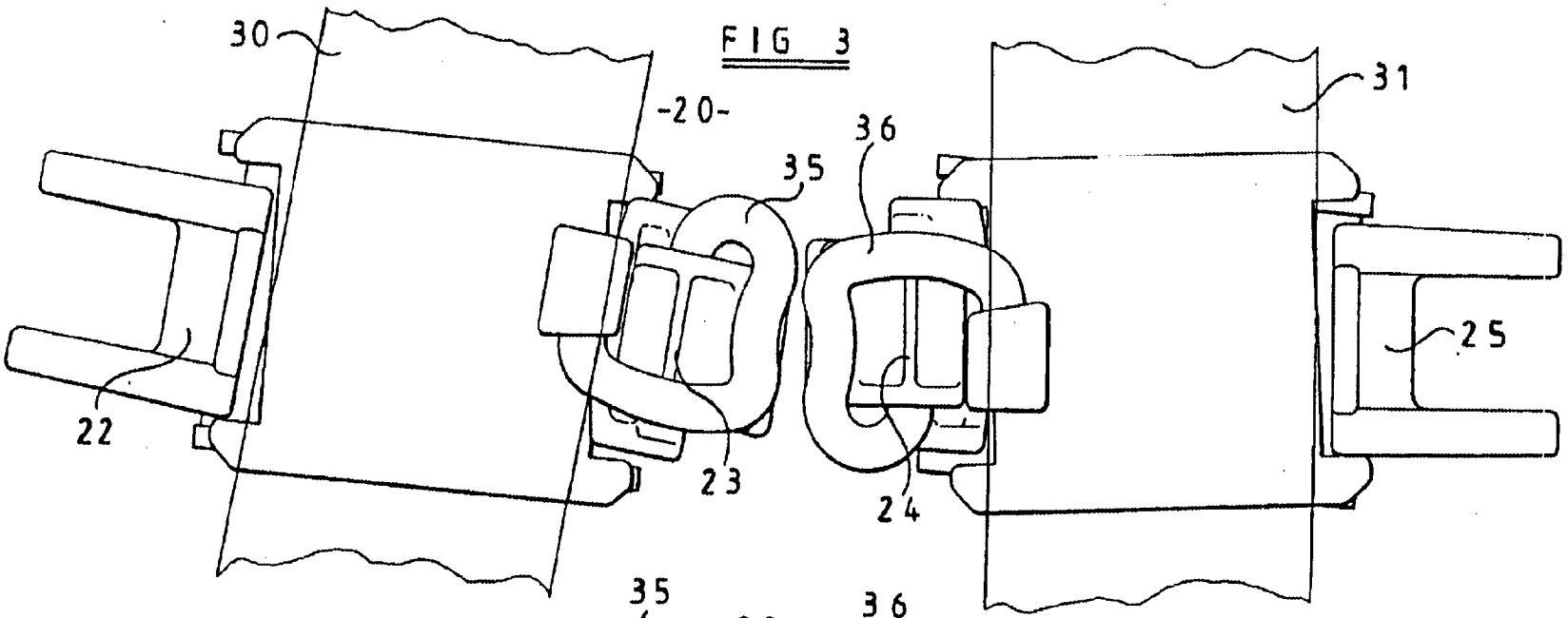
FIGS. 3 and 4 are sections through plan and elevation views of two adjacent rail mounts according to the invention incorporating standard baseplates supporting converging rails.
Figure 4:
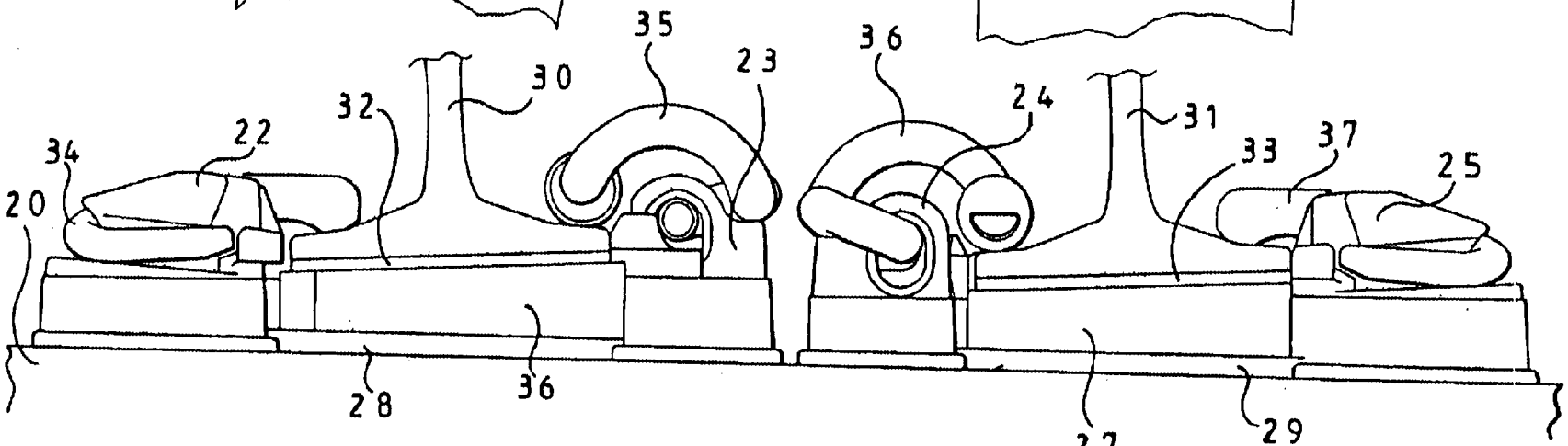

A rail mounting system according to the invention will now be described by way of example only with reference to FIGS. 3 to 7, in which:

FIGS. 3 and 4 show two rail mounts according to the invention on a flat rail bearing 20. Each rail mount comprises two upstanding shoulders 22, 23 and 24, 25 respectively cast into the rail bearing 20. Baseplates 26, 27 each lie on a 10mm thick grooved rubber baseplate pad 28, 29 on the rail bearing 20 between the shoulders 22, 23 and 24, 25. Each baseplate 26, 27 has cut-away sections at either end which enable them to fit snugly between the shoulders 22, 23 and 24, 25 without creeping out of position. Each baseplate also has a tapered section, which gives the upper surface an inclination of 1:20 with respect to the lower surface. The base flanges of the rails 30, 31 sit on studded rubber rail pads 32, 33 (thinner than the baseplate pads 28, 29) on the upper surface of the baseplates 26, 27 by virtue of which they adopt an inclination of 1:20 with respect to the rail bearing. The thicker pads 28, 29 may of course be interchanged with the thinner studded pads 32, 33. Each rail mount uses a different clip on either side of the rail, one being a Pandrol Fastclip FCl504™ clip 34, 37, the other being a Pandrol e-Plus2000™ clip 35, 36 fastened to the shoulders 22, 25 and 23, 24 respectively to bear down onto the flanges of the rails 30 31 to hold them securely to the baseplates 26, 27 and rail bearing 20. The shoulders 22, 23, 24, 25 are each provided with suitable clip mounting features at positions which enable the clips 34, 35, 36, 37 to bear with appropriate force down onto the rails 30, 31. In view of the inclination of the rails 30, 31, one of the clips 35, 37 by each rail must be mounted higher than the other ones, and for this reason the respective shoulders 23, 25 are higher than the others 22, 24.

In the rail mounting system so described, the baseplates 26, 27 are secured to the rail bearing solely by virtue of the compressive forces exerted by the clips 34, 35, 36, 37 through the base flanges of the rails. Any variations in the height of the clip mountings relative to the upper surfaces of the baseplates and rail flanges due to manufacturing tolerances will affect the force exerted by the clips on the rail flanges, but the force will not be compounded by the 'see-saw' effect caused by the clip arrangement of the pop-up shoulder rail mounting system, in which the force exerted by the toe of the clip is also dependent on the height of the baseplate under the heel of the clip. Thus, manufacturing tolerances are not as critical with the rail mounting system according to the invention.

Another advantage of securing the baseplates solely by a compressive force is that the baseplates are not subject to any tensile or bending stresses, such that relatively low strength materials may be used. The baseplates could therefore be moulded with weight-saving cavities in their centres. Such weight-saving cavities could be in the form of vertical blind holes extending from the lower surface of the baseplate, in which case the grooved rubber baseplate pads 28, 29 could be replaced with plain rubber pads, which would offer a degree of compressive resilience by virtue of the moulded holes.

The rail mounting system according to the invention may be used for mounting two converging rails as close as two shoulders' widths apart using standard baseplates with the mounts side by side. This represents a considerable saving of space over that required by the pop-up shoulder rail mounting system, and ensures that fewer special baseplates are required for each switch and crossing.

Figure 5:
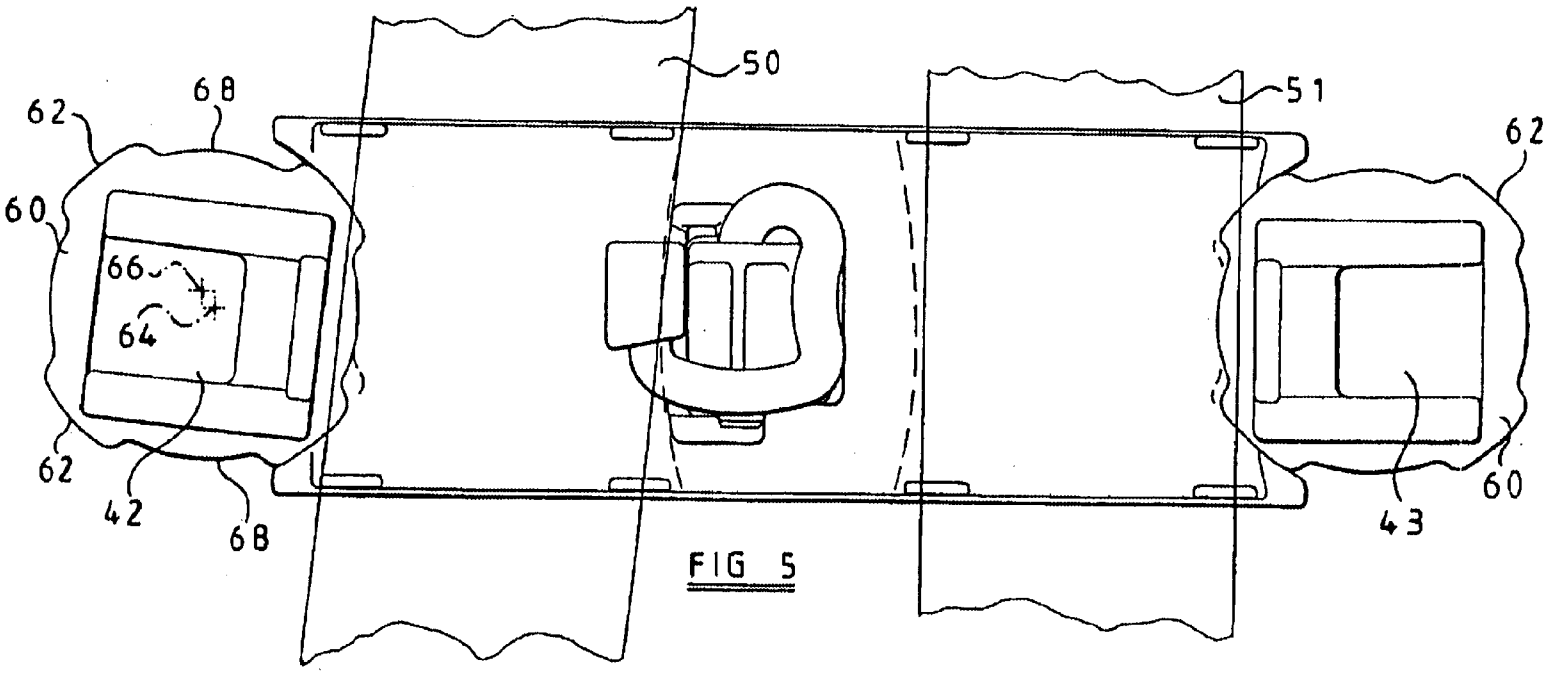
FIGS. 5 and 6 are sections through plan and elevation views of a rail mount according to the invention incorporating a special baseplate supporting converging rails.
Figure 6:
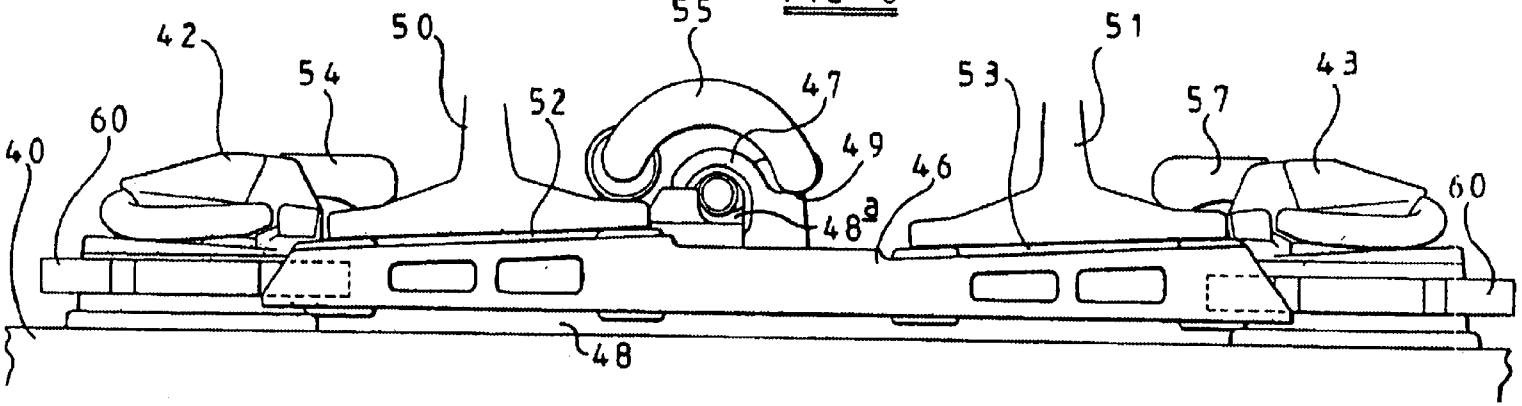

FIGS. 5 and 6 show a rail mount for two adjacent converging rails which are too close together to fit two separate rail mounts using standard baseplates as described with reference to FIGS. 3 and 4. The rail mount comprises two upstanding square-section shoulders 42, 43 cast into the rail bearing 40 and spaced sufficiently far apart to enable both rails 50, 51 to sit between them. A special baseplate 46 long enough to support both rails 50, 51 lies on a 10mm thick grooved rubber baseplate pad 48 on the rail bearing 40 between the shoulders 42, 43. The baseplate 46 is formed with an upper surface presenting two rail-supporting areas, each tapered with an inclination of 1:20 with respect to the lower surface. Between the two rail-supporting areas, the baseplate has a cast-in upstanding shoulder 47. The base flanges of the rails 50, 51 sit on studded rubber rail pads 52, 53 on the two rail-supporting areas of the baseplate 46, by virtue of which they adopt an inclination of 1:20 with respect to the rail bearing. The shoulders 42, 43 are each provided with suitable mounting features to enable Pandrol Fastclip FCl504™ clips 54, 57 to be fastened to the shoulders 42, 43 at positions which enable the clips to bear down with appropriate force onto the outer flanges of the rails 50, 51 to hold them securely to the baseplate 46 and rail bearing 40. In view of the inclination of the rails 50, 51, one of the clips 57 is mounted higher than the other one, and for this reason its respective shoulder is 43 is higher than the other shoulder 42. The shoulder 47 cast into the baseplate is provided with an orifice 48 and reaction pad 49 at a position suitable for anchoring a Pandrol e-Plus2000™ clip 55 such that its toe bears down onto the inner flange of one of the rails 50.

A predominantly circular flat adjustment ring 60 having a square inner aperture slightly larger than the square section of the shoulders 42, 43 sits around the base of each shoulder. The circular periphery of each ring is formed with four lobes 62 of increased diameter equi-angularly spaced around the ring. The axis 64 of the inner aperture of each ring is slightly off-set from the axis 66 of the outer diameter defined by the four lobes 62, such that the predominantly circular outer periphery presents a cam profile with respect to the axis of the shoulder 42, 43 around which the ring sits. The outer periphery of each ring 60 abuts respective ends of the baseplate 46, each end having a matching circular profile that serves to positively locate the baseplate between the rings 60 and hence the shoulders 42, 43.

By virtue of the square aperture, each ring 60 can be placed in four positions around its respective shoulder. In each position, one lobe 62 and the arc 68 between two adjacent lobes will be in contact with the end of the baseplate 46. In each position, the segment of the outer periphery in abutment with the baseplate 46 will be a different distance from the axis of the shoulder due to the cam profile of the periphery. Thus, the rings 60 provide a degree of adjustment of the position of a baseplate relative to the rail bearing to enable a smaller total number of special baseplate designs to be suitable for use with all standard switch and crossing track geometries, the adjustment being used to compensate for small differences in spacings between the rails at the different switches and crossings.

The adjustment ring provides four discrete spacings between the axis 64 of the shoulders 42, 43. If four discrete spacings are not sufficient to enable standard baseplates to be used in all cases, adjustment segments may instead be provided. As shown in FIG. 7, each adjustment segment 70 has an outer contour 72 which provides a contact face with the end of the baseplate 46. Opposite the outer contour 72 is a recess 74 into which the shoulder 42, 43 is housed. Different adjustment segments then provide a different spacing between the outer contour 72 and the central axis 64 of the shoulder 42, 43. Of course, the outer contour 72 can be any suitable shape, to match the profile of the ends of the baseplate 46. Any suitable number of segments can then be selected, for example five to ten.

The invention is described herein with reference to FIGS. 3 to 6 by way of example only. It will be clear that the invention extends to further modifications not described. For example, although different clips have been used with different shoulders, it will be clear that other types of clips and shoulders could be used in accordance with the invention. In particular, all of the clips and shoulders could be Pandrol Fastclip FCl504™ type clips or alternatively, they could all be Pandrol e-Plus2000™ type clips. Furthermore, the adjustment rings could be formed with apertures of a non-square shape.

What is claimed is:

1. A rail mounting system for mounting a rail to a rail bearing, the mounting system comprising a tapered baseplate for supporting the base flange of a rail on the rail bearing at an inclination thereto, and clamp means mounted on a shoulder upstanding from the rail bearing for urging the base flange of the rail onto the baseplate and rail bearing, wherein the baseplate is secured to the rail bearing solely by virtue of the compressive force exerted by the clamp means through the base flange of the rail, wherein the system further comprises a baseplate locator comprising a ring or section of a ring mounted around the shoulder and having a peripheral edge that abuts the end of the baseplate to provide a positive location of the baseplate between the shoulders.

2. A system as claimed in claim 1, wherein the baseplate locator comprises a complete ring, and the peripheral edge has a cam profile to allow adjustment of the location of the baseplate by rotation of the ring about the axis of the shoulder.

3. A rail mounting system according to claim 1, wherein the clamp means comprises clamps connected to the rail bearing at either end of the baseplate.

4. A rail mounting system according to claim 3, wherein each clamp comprises a clip mounted at a suitable height relative to the rail bearing to bear down onto the base flange of the rail.

5. A rail mounting system according to claim 1, wherein the baseplate locator comprises a segment located by the shoulder.

6. A rail mounting system for mounting a rail to a rail bearing, the mounting system comprising a tapered baseplate for supporting the base flange of a rail on the rail bearing at an inclination thereto, and clamp means for urging the base flange of the rail onto the baseplate and rail bearing, wherein the clamp means comprises a shoulder which is secured to the rail bearing and further comprises a clip having a toe and a heel, and wherein the toe of the clip bears down on the base flange of the rail and the heel of the clip means bears down on the shoulder, wherein the system further comprises a baseplate locator comprising a ring or section of a ring mounted around the shoulder and having a peripheral edge that abuts the end of the baseplate to provide a positive location of the baseplate between the shoulders.

7. A rail mounting system as claimed in claim 6, comprising first and second clamp means at opposite sides of the rail, wherein the baseplate is located entirely between the outer edges of the first and second clamp means.

8. A rail mounting system as claimed in claim 7, wherein the length of the baseplate is substantially equal to the spacing between the inner edges of the first and second clamp means.

9. A rail mounting system as claimed in claim 6, wherein the mounting system is for mounting two converging rails, and wherein the baseplate is continuous between first and second outer clamp means.

10. A rail mounting system as claimed in claim 6, wherein the baseplate locator comprises a complete ring and the peripheral edge has a cam profile to allow adjustment of the location of the baseplate by rotation of the ring about the axis of the shoulder.

* * * * *